US009021723B2

(12) United States Patent
Meyer et al.

(10) Patent No.: US 9,021,723 B2
(45) Date of Patent: May 5, 2015

(54) WATERPROOF BREATHABLE BOOT

(76) Inventors: Greg Meyer, Council Bluffs, IA (US); Christian Curtis, Council Bluffs, IA (US); Eric Larsgaard, Council Bluffs, IA (US)

( * ) Notice: Subject to any disclaimer, the term of this patent is extended or adjusted under 35 U.S.C. 154(b) by 367 days.

(21) Appl. No.: 13/543,441

(22) Filed: Jul. 6, 2012

(65) Prior Publication Data

US 2013/0008051 A1 Jan. 10, 2013

Related U.S. Application Data

(60) Provisional application No. 61/571,982, filed on Jul. 8, 2011.

(51) Int. Cl.

| | |
|---|---|
| ***A43B 7/06*** | (2006.01) |
| ***A43B 5/00*** | (2006.01) |
| ***A43B 19/00*** | (2006.01) |
| ***A43B 7/12*** | (2006.01) |
| ***A43B 23/02*** | (2006.01) |
| ***A43B 23/06*** | (2006.01) |
| ***A43B 23/07*** | (2006.01) |

(52) U.S. Cl.

CPC ..... *A43B 7/125* (2013.01); *A43B 19/00* (2013.01); *A43B 23/022* (2013.01); *A43B 23/06* (2013.01); *A43B 23/07* (2013.01)

(58) Field of Classification Search

CPC ..... A43B 7/125; A43B 19/00; A43B 23/07; A43B 23/06; A43B 23/22; A43B 23/08; A43B 1/10

USPC ..... 36/45, 4, 3 R, 3 A, 131, 55, 68, 69, 77 R, 36/10

See application file for complete search history.

(56) References Cited

U.S. PATENT DOCUMENTS

| | | | | |
|---|---|---|---|---|
| 3,022,583 | A | 2/1962 | Bingham. Jr. | |
| 4,693,021 | A * | 9/1987 | Mazzarolo | 36/131 |
| 5,647,150 | A * | 7/1997 | Romanato et al. | 36/117.1 |
| 6,154,884 | A | 12/2000 | Dehner | |
| 6,202,324 | B1 | 3/2001 | Whitlock | |
| 6,474,002 | B2 | 11/2002 | Chen | |
| 6,665,954 | B2 * | 12/2003 | Chen | 36/3 R |
| 7,441,351 | B2 * | 10/2008 | Clark et al. | 36/138 |
| 7,530,182 | B2 * | 5/2009 | Munns | 36/131 |
| 7,730,640 | B2 | 6/2010 | Clark et al. | |
| 2003/0121181 | A1 * | 7/2003 | Chang | 36/45 |
| 2004/0200094 | A1 * | 10/2004 | Baychar | 36/55 |
| 2008/0201987 | A1 * | 8/2008 | Bell | 36/84 |
| 2010/0306897 | A1 | 12/2010 | Wood et al. | |

* cited by examiner

*Primary Examiner* — Jila M Mohandesi
*Assistant Examiner* — Katharine Gracz
(74) *Attorney, Agent, or Firm* — Dennis L. Thomte; Thomte Patent Law Office LLC

(57) ABSTRACT

A waterproof breathable boot is disclosed. The boot includes an outsole, a three-piece bootie, a toe cap, a heel cap, a center front panel, an instep panel and a rear panel.

14 Claims, 2 Drawing Sheets

WATERPROOF BREATHABLE BOOT

CROSS-REFERENCE TO RELATED APPLICATION

This application claims the priority date of Jul. 8, 2011 relating to the provisional application, Ser. No. 61/571,982, entitled WATER-PROOF BREATHABLE BOOT.

BACKGROUND OF THE INVENTION

1. Field of the Invention

This invention relates to a boot and more particularly to a waterproof breathable boot.

2. Description of the Related Art

Currently the boot market in many industries has different options for the end user in terms of waterproof breathable boot styles. One smaller industry that is currently dominated by rubber PVC or Neoprene construction has yet to introduce a waterproof breathable boot. This market has the problem of feet overheating, creating moisture in the boot and then conducting cold. The boots are used for fishing on boats in Alaska, turkey hunting in the Midwest, gardening in wet, cool weather, etc. The boots do a fair job of regulating heat loss until the heat buildup in the boot rises to the point of perspiration. Once this stage is met, the moisture content conducts cold should the user reduce activity resulting in cold feet.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A waterproof breathable boot is disclosed comprising an outsole having a toe portion, a heel portion, an upper side and a lower side. A multi-layer breathable bootie is provided having a toe portion, a heel portion, an instep portion, and an upstanding generally tubular portion having an open upper end, a front side, a rear side, a first side and a second side. The bootie is secured to the upper side of the outsole and extends upwardly therefrom. A toe cap is secured to the toe end of the outsole which embraces the toe portion of the bootie and which is secured thereto. The toe cap is comprised of a waterproof elastic material such as rubber or Neoprene. The boot also includes a center front panel having an upper end, a lower end, a first side, a second side, a front side and a rear side. The center front panel is also comprised of a waterproof elastic material such as rubber or Neoprene. The lower end of the center front panel is secured to the toe cap with the rear side of the center front panel being secured to the front side of the bootie. A plurality of substantially horizontally disposed and vertically spaced-apart panel members are secured to the center front panel and which extend rearwardly therefrom at both the first and second sides thereof and which are secured to the bootie. The panel members are also comprised of a waterproof elastic material such as rubber or Neoprene. The boot also includes in instep panel which extends rearwardly from both sides of the center panel. The instep panel has a plurality of spaced-apart openings formed therein which expose the bootie. The boot also includes a rear panel having a front side, a rear side, a first side, a second side, an upper end and a lower end. The rear panel is also comprised of a waterproof elastic material such as rubber or Neoprene. The rear panel is secured at its lower end to a heel cap and extends upwardly therefrom. The rear panel is secured at its front side to the bootie. The rear panel has a plurality of horizontally disposed and vertically spaced-apart openings formed therein which expose portions of the bootie. A vertically disposed gusset is provided in the bootie at the first side thereof at the upper end thereof and has an adjustment means associated therewith. A horizontally disposed and ring-shaped reinforcing member is secured to the upper end of center front panel, the upper end of the bootie and the upper end of the rear panel.

The bootie is comprised of an inner membrane, an intermediate membrane and an outer membrane. The inner membrane is comprised of a knit fabric with the intermediate membrane being comprised of a waterproof breathable membrane of moisture management direction construction. The outer membrane is comprised of a 600 denier polyester material.

It is a principal object of the invention to provide a waterproof breathable boot.

A further object of the invention is to provide a waterproof breathable boot which is able to regulate the temperature that the end user is experiencing.

A further object of the invention is to provide a waterproof breathable boot which has moisture management properties whether it is a chemical reaction or a physical migration of the expended moisture.

A further object of the invention is to provide a boot of the type described which allows the moisture to breathe to the exterior of the boot.

A further object of the invention is to provide a boot of the type described such that it is appropriate for all activities.

A further object of the invention is to provide a waterproof breathable boot which is durable in use, refined in appearance and economical of manufacture.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 2:
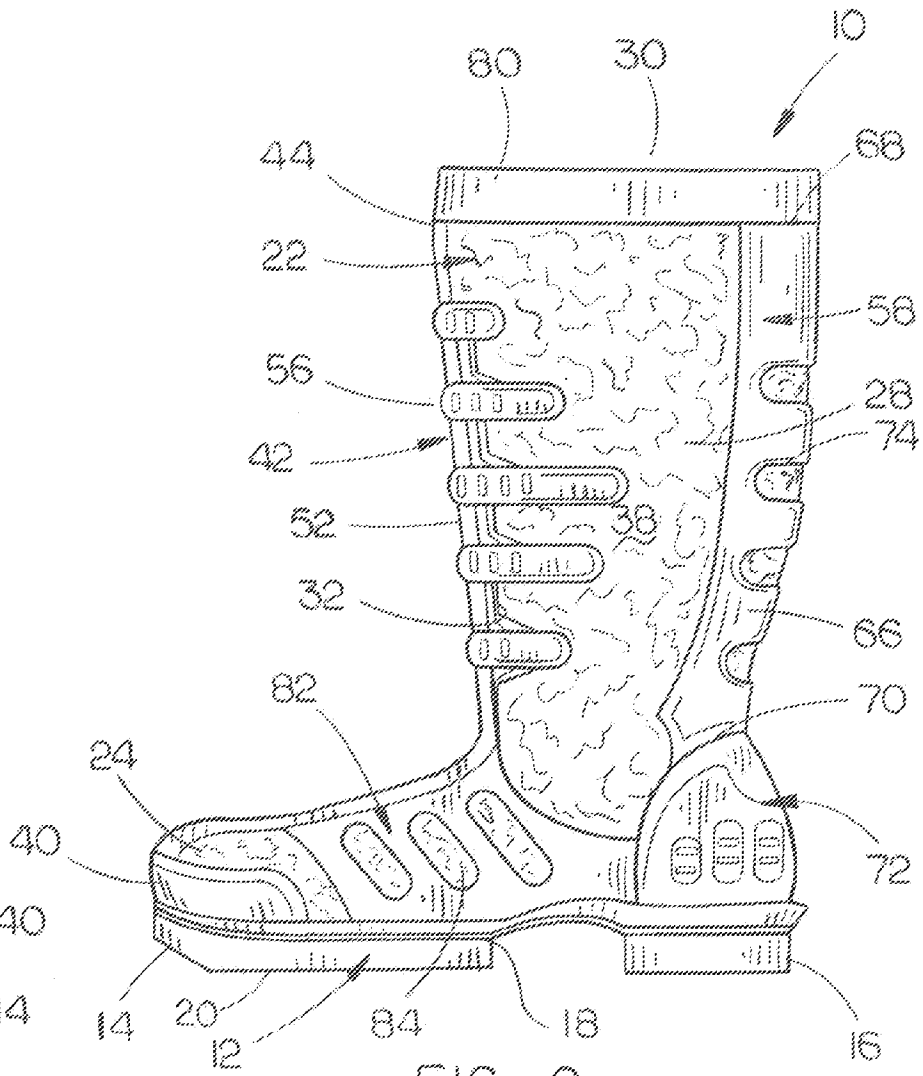
FIG. 2 is an opposite side view of the boot of FIG. 1.
Figure 1:
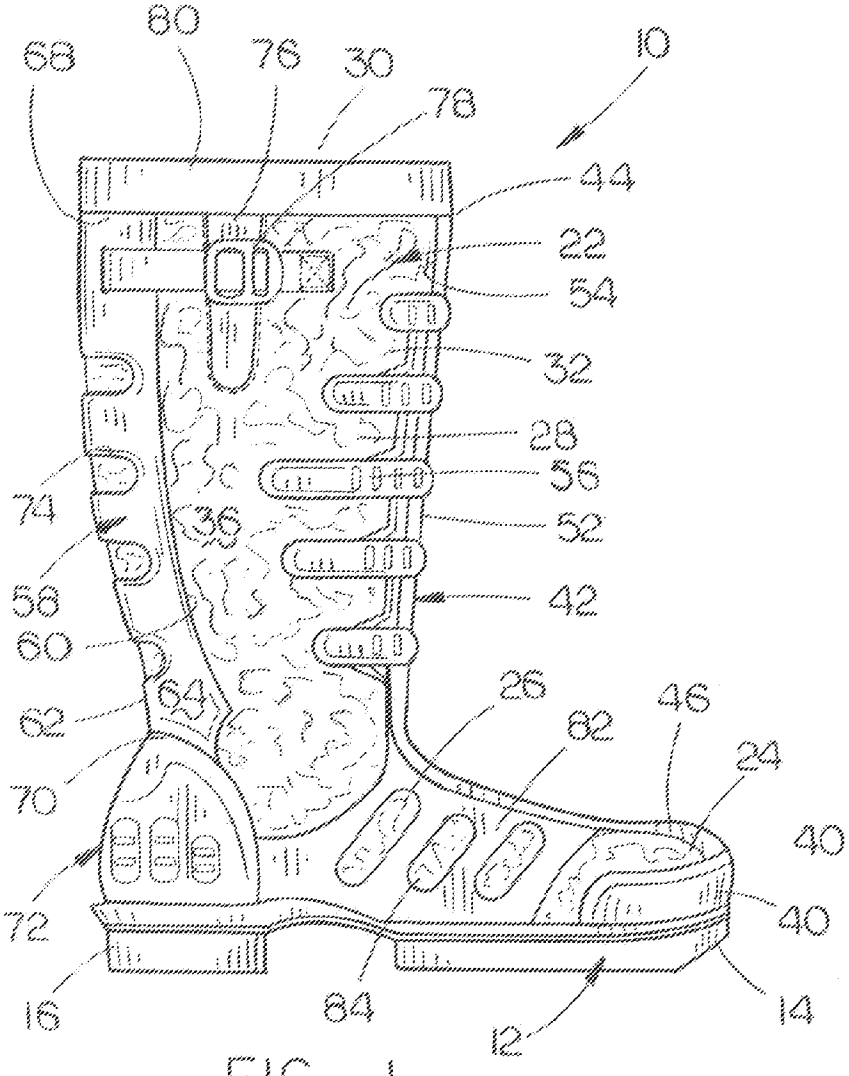
FIG. 1 is a side view of the boot of this invention.
Figure 3:
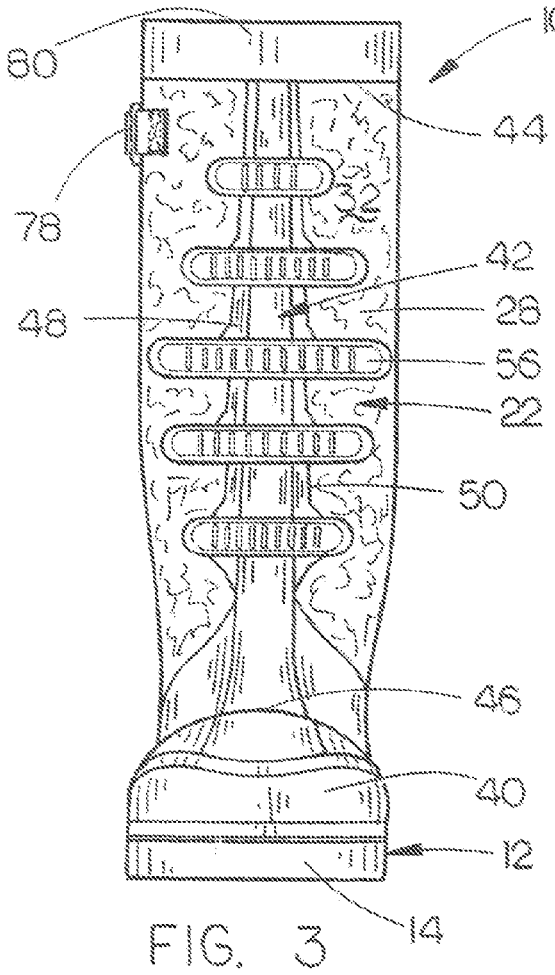
FIG. 3 is a front view of the boot of this invention.
Figure 4:
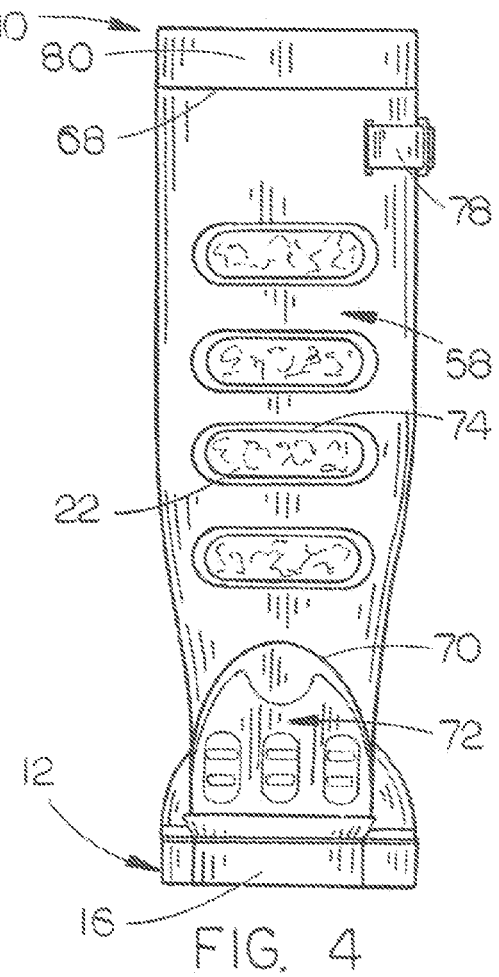
FIG. 4 is a back view of the boot of this invention.
Figure 5:
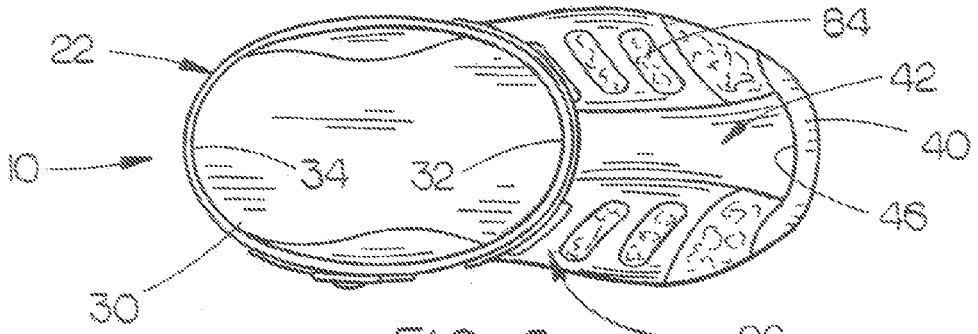
FIG. 5 is a top view of the boot of this invention.
Figure 6:
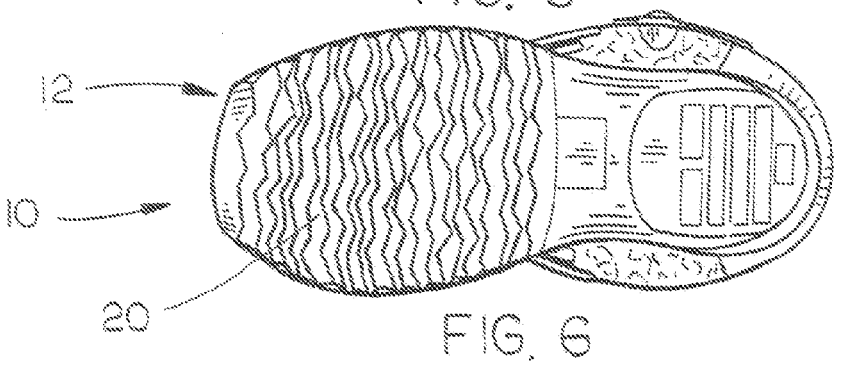
FIG. 6 is a bottom view of the boot of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The waterproof breathable boot of this invention is generally designated by the reference numeral 10. The boot shown in the drawings is a "right" boot. The "left" boot is a mirror image of the "right" boot. Boot 10 includes an outsole 12 having a toe portion 14, a heel portion 16, an upper side 18 and a lower side 20. A multi-layer breathable bootie 22 is provided which has a toe portion 24, a heel portion (not shown in the drawings) and instep portion 26, and an upstanding generally tubular portion 28 having an open upper end 30, a front side 32, a rear side 34, a first side 36 and a second side 38. The bootie 22 is secured to the upper side of the outsole by glue or the like and extends upwardly therefrom.

A toe cap 40 is secured to the toe portion 14 of the outsole 12 which embraces the toe portion 24 of the bootie 22 and which is secured thereto. The toe cap 40 is comprised of a waterproof elastic material such as rubber or Neoprene.

The boot 10 also includes a center front panel 42 having an upper end 44, a lower end 46, a first side 48, a second side 50, a front side 52 and a rear side 54. The center front panel 42 is comprised of a waterproof elastic material such as rubber or Neoprene. The lower end 46 of the center front panel 42 is secured to the toe cap 40 with the rear side 54 of the center front panel 42 being secured to the front side 32 of the bootie 22.

A plurality of substantially horizontally disposed and vertically spaced-apart panel members 56 are secured to the center front panel 42 which extends rearwardly therefrom at both the first and second sides thereof and which are secured to the bootie 22 by glue or the like. The panel members 56 are comprised of a waterproof elastic material such as rubber or Neoprene. The boot 10 also includes a rear panel 58 having a front side 60, a rear side 62, a first side 64, a second side 66, an upper end 68 and a lower end 70. The rear panel 58 is also comprised of a waterproof elastic material such as rubber or Neoprene. The rear panel 58 is secured at its lower end 70 to a heel cap 72 which is secured to the heel portion 16 of outsole 12 and which extends upwardly therefrom. The rear panel 58 is secured at its front side 60 to the bootie 22 by glue or the like. The rear panel 58 has a plurality of horizontally disposed and vertically spaced-apart openings 74 formed therein which expose portions of the bootie 22.

A vertically disposed gusset 76 is provided in the bootie 22 at the first side thereof at the upper end thereof and has an adjustment means 78 associated therewith. A horizontally disposed and ring-shaped reinforcing member 80 is secured to the upper end 44 of center front panel 42, the upper end of the bootie 22 and the upper end of the rear panel 58.

The bootie 22 is comprised of an inner membrane, an intermediate membrane and an outer membrane. The inner membrane is comprised of a knit fabric with the intermediate membrane being comprised of a waterproof breathable membrane of moisture management direction construction. The outer membrane is comprised of a 600 denier polyester material.

The boot 10 also includes an instep panel 82 which extends from both sides of the center front panel 42. Instep panel 82 has a plurality of spaced-apart openings 84 formed therein which expose the bootie 22. Instep panel 82 is secured to bootie 22 by glue or the like and is secured to said outsole.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. A waterproof breathable boot comprising:

an outsole having a toe portion, a heel portion, an upper side and a lower side;

a multi-layer breathable bootie having a toe portion, a heel portion, an instep portion, and an upstanding generally tubular portion having an open upper end, a front side, a rear side, a first side and a second side;

said bootie being secured to said upper side of said outsole and extending upwardly therefrom;

a toe cap secured to said toe end of said outsole which embraces said toe portion of said bootie and which is secured thereto;

said toe cap being comprised of a waterproof elastic material;

a center front panel having an upper end, a lower end, a first side, a second side, a front side and a rear side;

said center front panel being comprised of a waterproof elastic material;

said lower end of said center front panel being secured to said toe cap;

said rear side of said center front panel being secured to said front side of said bootie;

a plurality of substantially horizontally disposed and vertically spaced-apart panel members secured to said center front panel and which extend rearwardly therefrom at both said first and second sides thereof which are secured to said bootie;

said panel members being comprised of a waterproof elastic material;

an instep panel extending from both of said first and second sides of said center front panel;

said instep panel having a plurality of spaced-apart through openings formed therein which expose said bootie;

said instep panel being secured to said bootie and said outsole;

said instep panel being comprised of a waterproof elastic material;

a rear panel having a front side, a rear side, a first side, a second side, an upper end and a lower end;

said rear panel being comprised of a waterproof elastic material;

a heel cap secured to said lower end of said rear panel;

said rear panel being secured at its said lower end to said heel cap and extending upwardly therefrom;

said heel cap being secured to said heel portion of said outsole and extends upwardly therefrom;

said rear panel being secured at its said front side to said bootie;

said rear panel having a plurality of horizontally disposed and vertically spaced-apart through openings formed therein which expose portions of said bootie.

2. The boot of claim 1 wherein said waterproof elastic material is comprised of rubber.

3. The boot of claim 1 wherein said waterproof elastic material is comprised of Neoprene.

4. The boot of claim 1 wherein said bootie is comprised of an inner membrane, an intermediate membrane and an outer membrane.

5. The boot of claim 4 wherein said inner membrane is comprised of a knit fabric.

6. The boot of claim 5 wherein said intermediate membrane is comprised of a waterproof breathable membrane of moisture management direction construction.

7. The boot of claim 6 wherein said outer membrane is comprised of a 600 denier polyester material.

8. A waterproof breathable boot comprising:

an outsole having a toe portion, a heel portion, an upper side and a lower side;

a multi-layer breathable bootie having a toe portion, a heel portion, an instep portion, and an upstanding generally tubular portion having an open upper end, a front side, a rear side, a first side and a second side;

said bootie being secured to said upper side of said outsole and extending upwardly therefrom;

a toe cap secured to said toe end of said outsole which embraces said toe portion of said bootie and which is secured thereto;

said toe cap being comprised of a waterproof elastic material;

a center front panel having an upper end, a lower end, a first side, a second side, a front side and a rear side;

said center front panel being comprised of a waterproof elastic material;

said lower end of said center front panel being secured to said toe cap;

said rear side of said center front panel being secured to said front side of said bootie;

a plurality of substantially horizontally disposed and vertically spaced-apart panel members secured to said center front panel and which extend rearwardly therefrom at both said first and second sides thereof which are secured to said bootie;

said panel members being comprised of a waterproof elastic material;

an instep panel extending from both of said first and second sides of said center front panel;

said instep panel having a plurality of spaced-apart through openings formed therein which expose said bootie;

said instep panel being secured to said bootie and said outsole;

said instep panel being comprised of a waterproof elastic material;

a rear panel having a front side, a rear side, a first side, a second side, an upper end and a lower end;

said rear panel being comprised of a waterproof elastic material;

a heel cap secured to said lower end of said rear panel;

said rear panel being secured at its said lower end to said heel cap and extending upwardly therefrom;

said heel cap being secured to said heel portion of said outsole and extends upwardly therefrom;

said rear panel being secured at its said front side to said bootie;

said rear panel having a plurality of horizontally disposed and vertically spaced-apart through openings formed therein which expose portions of said bootie;

a vertically disposed gusset provided in said bootie at said first side thereof at said upper end thereof;

an adjustment means associated with said gusset;

and a horizontally disposed and ring-shaped reinforcing member secured to said upper end of said center front panel, said upper end of said bootie and said upper end of said rear panel.

9. The boot of claim 8 wherein said waterproof elastic material is comprised of rubber.

10. The boot of claim 8 wherein said waterproof elastic material is comprised of Neoprene.

11. The boot of claim 8 wherein said bootie is comprised of an inner membrane, an intermediate membrane and an outer membrane.

12. The boot of claim 11 wherein said inner membrane is comprised of a knit fabric.

13. The boot of claim 12 wherein said intermediate membrane is comprised of a waterproof breathable membrane of moisture management direction construction.

14. The boot of claim 13 wherein said outer membrane is comprised of a 600 denier polyester material.

* * * * *